United States Patent [19]

Josefsson et al.

[11] Patent Number: 4,586,648

[45] Date of Patent: May 6, 1986

[54] PACKING TROUGH AND BLANK THEREFOR

[75] Inventors: Claes G. Josefsson, Värmdö ; Rolf Andersson, Lund, both of Sweden

[73] Assignees: Glace-Bolaget AB; AB Akerlund & Rausing, both of Sweden

[21] Appl. No.: 589,171

[22] Filed: Mar. 13, 1984

[30] Foreign Application Priority Data

Mar. 17, 1983 [SE] Sweden ..... 8301463-9

[51] Int. Cl.[4] ..... B65D 5/24

[52] U.S. Cl. ..... 229/114; 229/146; 229/187

[58] Field of Search ..... 229/44 R, 31 FS, 31 R, 229/34 R

[56] References Cited

U.S. PATENT DOCUMENTS

| | | | |
|---|---|---|---|
| 978,569 | 12/1910 | Elkin . | |
| 1,994,803 | 3/1935 | Atkins . | |
| 2,630,263 | 3/1953 | Ringler | 229/31 FS |
| 2,847,154 | 8/1958 | Frankenstein | 229/31 FS |
| 3,316,102 | 4/1967 | Doll et al. | 229/31 FS |
| 3,767,108 | 10/1973 | Arneson | 229/31 FS |
| 4,228,946 | 10/1980 | Kuchenbecker | 229/44 R |
| 4,260,098 | 4/1981 | Manizza et al. | 229/31 FS |
| 4,266,713 | 5/1981 | Maroszek | 229/44 R |
| 4,339,068 | 7/1982 | Brauner | 229/44 R |

FOREIGN PATENT DOCUMENTS

| | | |
|---|---|---|
| 3126037 | 3/1982 | Fed. Rep. of Germany . |
| 1007150 | 3/1952 | France . |
| 1029463 | 6/1953 | France . |
| 1129129 | 1/1957 | France . |
| 323329 | 4/1970 | Sweden . |

*Primary Examiner*—Joseph Man-Fu Moy

*Attorney, Agent, or Firm*—Lerner, David, Littenberg, Krumholz & Mentlik

[57] ABSTRACT

The invention relates to a packing trough adapted to be provided with a lid, consisting of a bottom and walls formed of a coherent blank and a lid preferably also coherent therewith and formed of the same blank.

The trough consists of a flat bottom section, lower wall sections sloping upwards and outwards therefrom and upper wall sections being generally perpendicular to the bottom, and there is at each of the corners between the lower wall sections a doubled portion which is folded so as to be coplanar with one of the lower wall sections adjoining such a corner and which is attached to said corner, said portion having a projection which also is doubled but folded so as to be coplanar with one of the upper wall sections, and attached thereto, said doubled portions and said equally doubled projections being adapted to seal the corners of the trough.

22 Claims, 4 Drawing Figures

PACKING TROUGH AND BLANK THEREFOR

The present invention relates to a packing trough adapted to be provided with a lid, consisting of a bottom and walls formed of a coherent blank and a lid preferably also coherent therewith and formed of the same blank.

For goods which are viscous or creamy, or at least substantially liquid under certain temperature conditions, trough type packages of plastic material are predominantly used today. In this connection the plastic trough may have such a rigidity as to be self-supporting or it may be mounted in a supporting frame of cardboard or like material. Prior art trough packages are expensive in manufacture and they require, at least in the latter of said two cases, a plastics forming machine and also an apparatus for erection and application of the cardboard support. With increasing prices for plastic material, packages, wholly or partly consisting of plastic material, have become more and more unattractive and for a long time one has tried to find some other material therefor. Cardboard material has long been used for capsule packages and also for certain types of trough-shaped packages, but for the type of goods mentioned above it has not been found expedient to use cardboard because in that case one would have to use a relatively circumstantial procedure to apply a liquid-tight lining in the trough after erection thereof. The object of the invention is to provide a packing trough made in one piece in such a way that it is perfectly tight also to highly liquid goods.

The essential characteristic of the trough according to the invention is that the trough consists of a flat bottom section, lower wall sections sloping upwards and outwards therefrom and upper wall sections generally perpendicular to the bottom, said bottom being polygonal and the lower wall sections having an inclination deviating from the upper wall sections, that there is at each of the corners between the lower wall sections a doubled portion which is folded so as to be coplanar with one of the lower wall sections adjoining such a corner and which is preferably attached to said corner, said portion having a projection preferably also doubled, which extends beyond or over the upper end of the corner between the abutting lower wall sections but folded so as to be coplanar with one of the upper wall sections, said doubled portions, provided along corners between the lower wall sections, being adapted to seal said corners, and the projections forming an extension thereof being provided to seal corners between the upper wall sections interconnected by projecting flaps.

This invention makes it possible to obtain a packing trough which is perfectly tight at the corners and which also has a minimum of cut section surfaces facing the interior of the trough and the goods contained therein. In food products packages using cardboard coated with plastics or the like, it is imperative that cut section surfaces, i.e. surfaces not coated with plastics or the like, should be avoided as much as possible in the interior of the trough because moisture and fat can penetrate into the cardboard material through the uncoated cut section surface and give rise to dissolution, discolouration and growth of bacteria.

The construction described has resulted in a not insignificant side effect, viz. that goods packed in troughs according to the invention can be frozen up much more rapidly than goods contained in conventional packages.

Due to the inclined wall sections there are formed longitudinal and transverse passages for the freezing air between piles of troughs according to the invention, at the same time as the vertical upper wall sections of the trough secure the required lateral stability also in case of high piles.

A preferred embodiment of the packing trough and a blank therefor will be described more fully below with reference to the accompanying drawings, in which FIG. 1 is a perspective diagonal top view of a packing trough provided with an opened lid;

Figure 1:
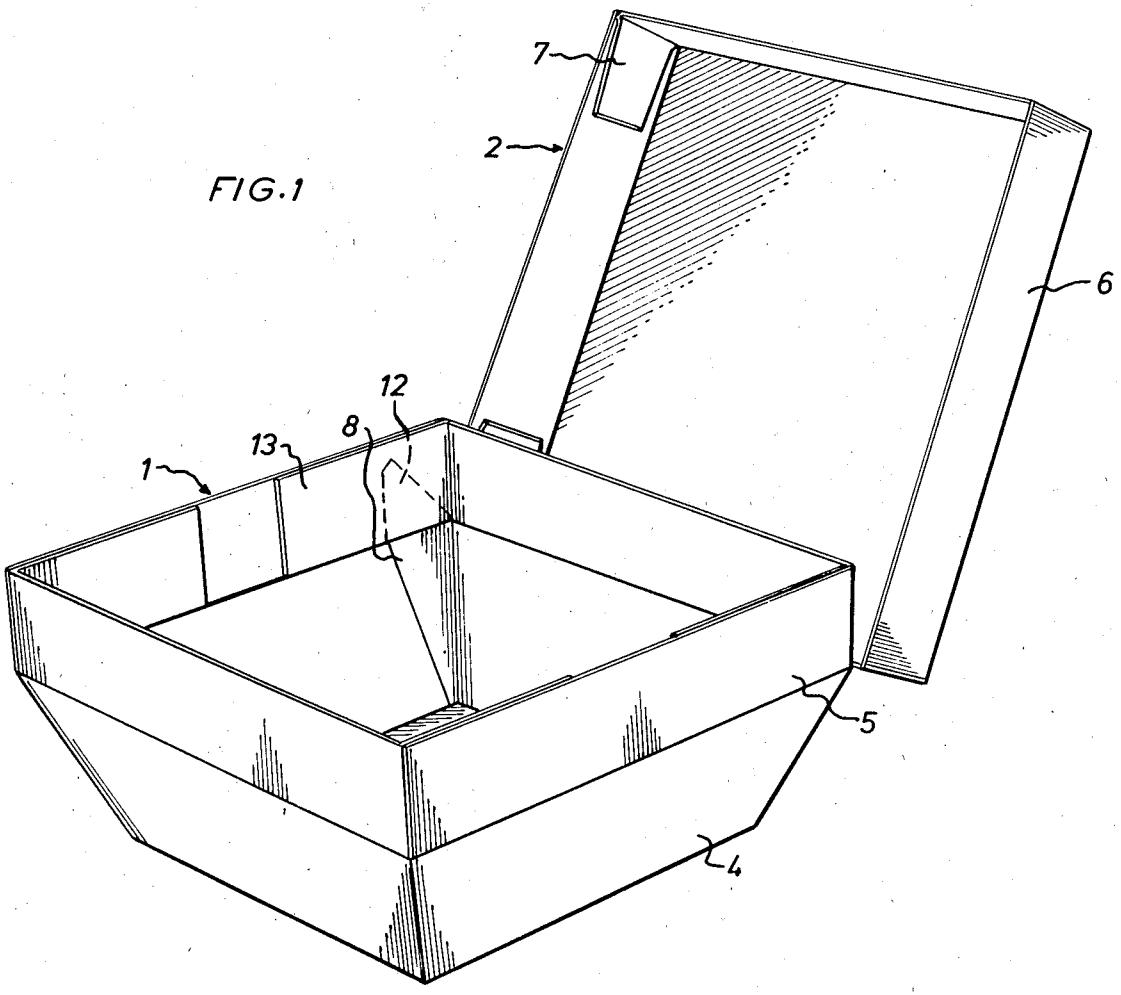
Figure 2:
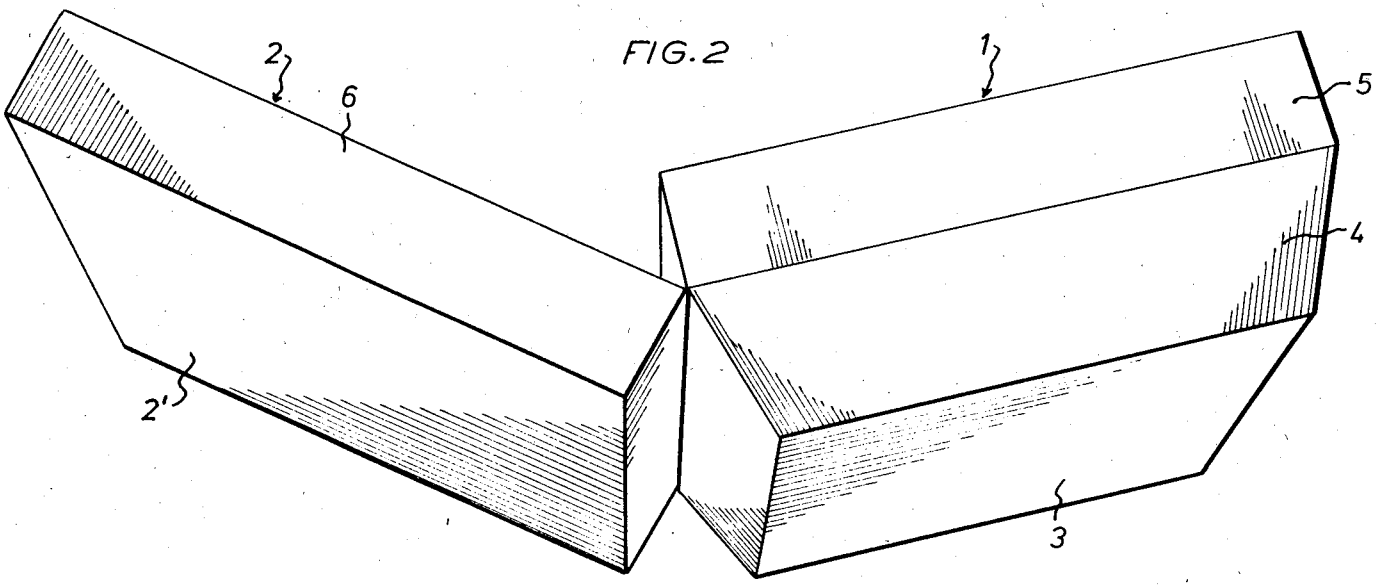
FIG. 2 is a diagonal bottom view of the same trough.
Figure 3:
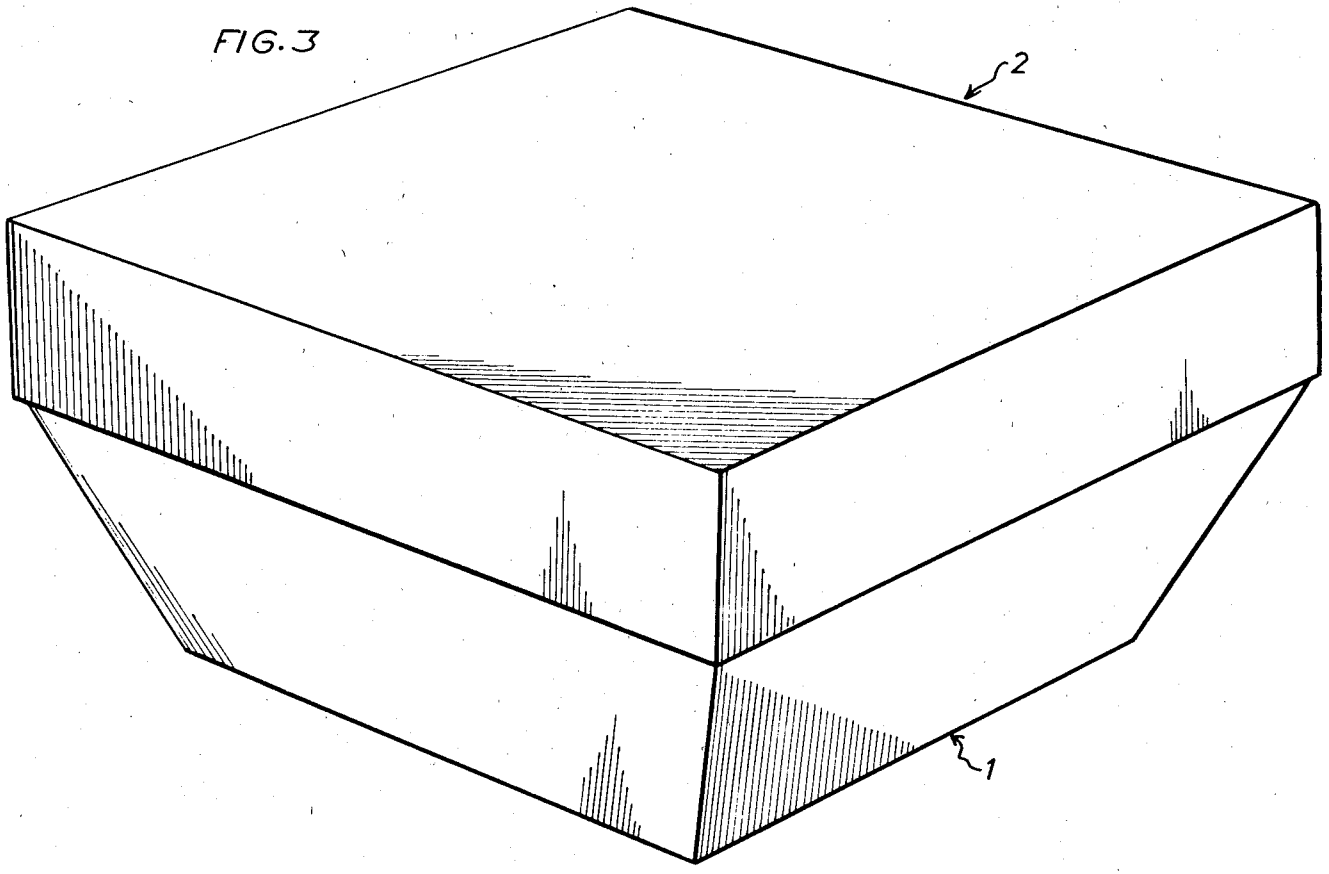
FIG. 3 is a diagonal top view of the trough with closed lid.

The trough package consists of the trough proper 1 and a lid 2. The trough consists of a rectangular bottom 3, outwardly inclined trapezoidal lower wall sections 4 and rectangular upper wall sections 5 perpendicular to the bottom plane. The lid consists of a rectangular lid top 2' and rectangular lid sides 6 two of which are provided with fastening flaps 7.

Figure 4:
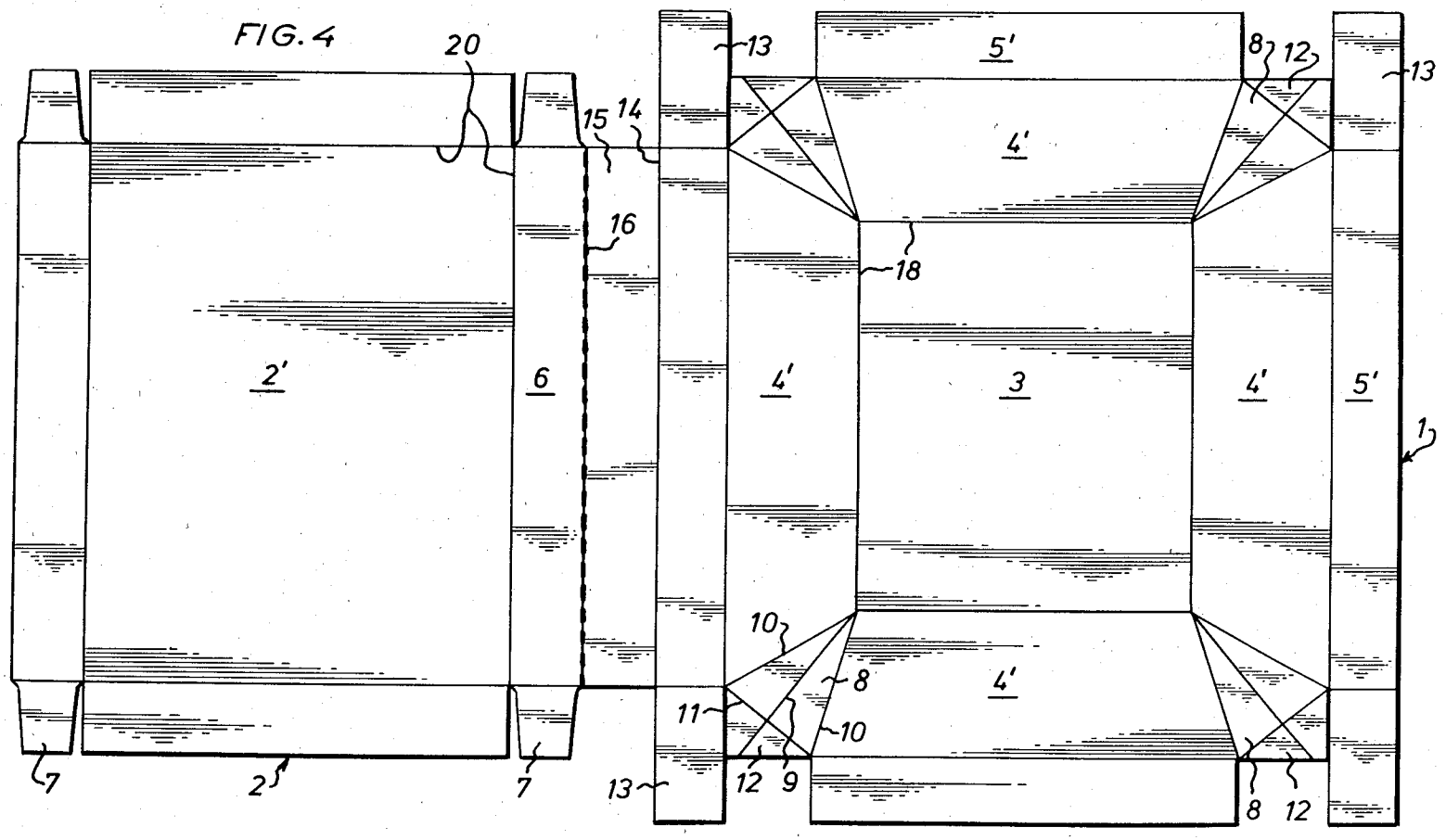
FIG. 4 shows a blank in spread-out condition designed for trough and lid.

As is best shown in FIG. 4, but also indicated in FIG. 1, the blank portions 4' forming the lower wall sections 4 have between them wedge-shaped portions 8 provided with a centrally extending crease notch 9. Between the wedge-shaped portions 8 and the wall sections 4' there are also crease notches 10 and the central crease notch 9 is crossed by a crease notch 11 extending between the upper and outer corners of the wall sections 4' and defining a triangular projection 12 adjoining the wedge-shaped portion 8.

At both ends of two of the material portions 5' constituting the upper wall sections 5 there are connection flaps 13. The wall section 5' facing the lid 2 is connected with one of the lid sides 6, via a crease notch 14 and an intermediate piece. A crease notch 16 between the intermediate piece 15 and the lid side 6 may be shaped as a tear-off notch.

There are crease notches 18 between the bottom and the lower wall sections, crease notches 19 between the lower wall sections 4' and the upper wall sections 5, and crease notches 20 between the lid top 2' and the lid sides 6.

When raising the trough 1 the wedge-shaped portions 8 are bent along the crease notches 9 at the same time as the lower wall sections 4' are raised upwards and the upper wall sections 5' are folded inwards. When the wedge-shaped portions 8 have been folded together completely, inwards or outwards, as shown, the portions thus doubled are bent sideways so that they will bear on the edge of the adjacent lower wall section 4 and can be attached thereto. When the wedge-shaped portion 8 has been doubled the equally doubled triangular projection 12 can be folded relative to the portion 8 along the crease notch 11 and be brought to bear against and be attached to the adjacent side of the upper wall section 5 whereupon the flaps 13 are folded over and attached to the projection and the adjoining upper wall section. The intermediate piece 15 is folded down on the outside of the upper wall section connected therewith and is attached to this section, whereupon the lid can be raised and fixed in that the fastening flaps 7 are connected with adjoining lid side portions 6. Thus the packing trough is erected and ready for use.

If the cardboard material is provided with a heat-sealable plastic coating the interconnection of the trough 1 and the lid 2 can be effected by means of heated vice means or jaws, providing a bond over the entire interfacing surfaces. It is also possible to utilise other cardboard material and fasten together the different portions by spot glueing.

As indicated the wedge-shaped portions 8 with the triangular projections 12 may be folded either outwards or inwards during raising. In both cases there is obtained at each corner only one joint line 21, FIG. 1, facing the interior of the trough, extending along the lower wall sections, and one joint line 22 extending along the edges of the flap 13 at the upper wall section.

The fact that the trough has upper wall sections which are perpendicular to the bottom makes it possible to design the lid construction in a simple manner. Since the lid is articulated with the trough at a distance from the upper edge of the latter, at the crease notch 16, there is obtained a good openability and sealability and the upper edge of the trough may be utilized for fastening a sealing foil or the like.

The invention must not be considered restricted to that described in the foregoing and shown in the drawings but may be modified in various ways within the scope of the appended claims.

What we claim and desire to secure by Letters Patent is:

1. A packing trough made from a blank, comprising a bottom section having a plurality of peripheral edges which define a polygonal shape; a plurality of sidewalls, each sidewall being attached to a corresponding one of said peripheral edges of said bottom section and including a lower wall section extending upwardly and outwardly from said corresponding one of said peripheral edges of said bottom section and an upper wall section extending upwardly from said lower wall section such that said upper wall section is generally perpendicular to said bottom section; and a plurality of corners, each of said corners being defined by a joint formed between a pair of adjacent sidewalls and including sealing means for sealing said corner, said sealing means including a tab connected between said pair of adjacent sidewalls, said tab including a first portion folded upon itself such that said first portion overlaps one of said lower wall sections of said pair of adjacent sidewalls in such a manner that said lower wall sections are in abutting relationship and a second portion folded upon itself such that said second portion overlaps one of said upper wall sections of said pair of adjacent sidewalls in such a manner that said upper wall sections are in abutting relationship.

2. The packing trough of claim 1, wherein said tab includes a central crease notch extending from said first portion of said tab to said second portion of said tab, said central crease notch dividing said second portion into two unsymmetrical parts.

3. The packing trough of claim 2, wherein said first portion of said tab has a triangular shape, whereby said first portion has a base and two sides, and wherein said second portion of said tab has a triangular shape, whereby said second portion has a base and two sides.

4. The packing trough of claim 3, wherein said first portion of said tab is folded upon itself along said central crease notch and wherein said second portion of said tab is folded upon itself along said central crease notch.

5. The packing trough of claim 4, wherein said base of said first portion is conincident with said base of said second portion.

6. The packing trough of claim 5, wherein said first portion of said tab is connected between said pair of adjacent sidewalls by a pair of additional crease notches, one of said additional crease notches being adjacent to one of said lower wall sections of said pair of adjacent sidewalls and the other of said additional crease notches being adjacent to the other of said lower wall sections of said pair of adjacent sidewalls.

7. The packing trough of claim 6, wherein said sealing means further includes flaps projecting from opposite ends of each of at least two opposed upper wall sections, each of said flaps being folded such that it is coplanar with an adjacent upper wall section.

8. The packing trough of claim 7, wherein each flap is attached to said second portion of a corresponding one of said tabs.

9. The packing trough of claim 8, wherein said flap overlies said second portion of said corresponding one of said tabs when said second portion is folded upon itself and said flap is folded into a coplanar relationship with said adjacent upper wall section.

10. The packing trough of claim 9, further comprising a lid which includes a top section having a plurality of peripheral edges which define a polygonal shape conforming with said polygonal shape of said bottom section of said trough; a plurality of sidewalls, each sidewall being attached to a corresponding one of said peripheral edges of said top section; and an intermediate wall member attached between one of said sidewalls of said lid and one of said upper wall sections of said trough, whereby said lid is formed integrally with said trough.

11. The packing trough of claim 10, wherein said siewalls of said lid and said intermediate wall member have the same height.

12. A cut and scored blank for a packing trough, said blank comprising a bottom section having a plurality of peripheral edges which define a polygonal shape; a plurality of sidewalls, each sidewall including a lower wall section pivotally attached to a corresponding one of said peripheral edges of said bottom section such that it is pivotable into a position in which it extends upwardly and outwardly from said corresponding one of said peripheral edges of said bottom section and an upper wall section pivotally attached to said lower section such that it is pivotable into a position in which it extends upwardly from said lower wall section generally perpendicular to said bottom section; and a plurality of corners, each of said corners being defined by a tab pivotally connected between said pair of adjacent sidewalls, said tab including a first portion being foldable upon itself such that said first portion overlaps one of said lower wall sections of said pair of adjacent sidewalls in such a manner that said lower wall sections are in abutting relationship and a second portion being foldable upon itself such that said second portion overlaps one of said upper wall sections of said pair of adjacent sidewalls in such a manner that said upper wall sections are in abutting relationship.

13. The blank of claim 12, wherein said tab includes a central crease notch extending from said first portion of said tab to said second portion of said tab, said central crease notch dividing said second portion into two unsymmetrical parts.

14. The blank of claim 13, wherein said first portion of said tab has a triangular shape, whereby said first portion has a base and two sides, and wherein said second portion of said tab has a triangular shape, whereby said second portion has a base and two sides.

15. The blank of claim 14, wherein said first portion of said tab is capable of being folded upon itself along said central crease notch and wherein said second portion of said tab is capable of being folded upon itself along said central crease notch.

16. The blank of claim 15, wherein said base of said first portion is coincident with said base of said second portion.

17. The blank of claim 16, wherein said first portion of said tab is connected between said pair of adjacent sidewalls by a pair of additional crease notches, one of said additional crease notches being adjacent to one of said lower wall sections of said pair of adjacent sidewalls and the other of said additional crease notches being adjacent to the other of said lower wall sections of said pair of adjacent sidewalls.

18. The blank of claim 17, further comprising flaps projecting from opposite ends of each of at least two opposed upper wall sections, each of said flaps having the capability of being folded such that it is coplanar with an adjacent upper wall section.

19. The blank of claim 18, wherein each flap is attached to said second portion of a corresponding one of said tabs.

20. The blank of claim 19, wherein said flap is capable of overlying said second portion of said corresponding one of said tabs when said second portion is folded upon itself and said flap is folded into a coplanar relationship with said adjacent upper wall section.

21. The blank of claim 20, further comprising a lid which includes a top section having a plurality of peripheral edges which define a polygonal shape conforming with said polygonal shape of said bottom section of said trough; a plurality of sidewalls, each sidewall being attached to a corresponding one of said peripheral edges of said top section; and an intermediate wall member attached between one of said sidewalls of said lid and one of said upper wall sections of said trough, whereby said lid is formed integrally with said trough.

22. The blank of claim 21, wherein said sidewalls of said lid and said intermediate wall member have the same height.

* * * * *